US010655093B2

(12) United States Patent
Somerville-Roberts et al.

(10) Patent No.: US 10,655,093 B2
(45) Date of Patent: May 19, 2020

(54) COMPACTED LIQUID LAUNDRY DETERGENT COMPOSITION

(71) Applicant: The Procter & Gamble Company, Cincinnati, OH (US)

(72) Inventors: Nigel Patrick Somerville-Roberts, Newcastle upon Tyne (GB); Alan Thomas Brooker, Newcastle upon Tyne (GB); Philip Frank Souter, Northumberland (GB); Dan Xu, Newcastle upon Tyne (GB); Jeremie Robert Marcel Gummel, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 57 days.

(21) Appl. No.: 15/170,973

(22) Filed: Jun. 2, 2016

(65) Prior Publication Data

US 2016/0355763 A1 Dec. 8, 2016

(30) Foreign Application Priority Data

Jun. 5, 2015 (EP) ..... 15170802
Mar. 3, 2016 (EP) ..... 16158405

(51) Int. Cl.

| | |
|---|---|
| ***C11D 1/22*** | (2006.01) |
| ***C11D 3/22*** | (2006.01) |
| ***C11D 11/00*** | (2006.01) |
| ***C11D 3/20*** | (2006.01) |
| ***C11D 17/00*** | (2006.01) |
| ***C11D 1/83*** | (2006.01) |
| ***C11D 1/66*** | (2006.01) |
| ***C11D 3/30*** | (2006.01) |
| ***C11D 3/50*** | (2006.01) |
| *C11D 1/72* | (2006.01) |

(52) U.S. Cl.

CPC ..... *C11D 11/0017* (2013.01); *C11D 1/22* (2013.01); *C11D 1/66* (2013.01); *C11D 1/83* (2013.01); *C11D 3/2041* (2013.01); *C11D 3/2044* (2013.01); *C11D 3/2065* (2013.01); *C11D 3/2068* (2013.01); *C11D 3/222* (2013.01); *C11D 3/225* (2013.01); *C11D 3/30* (2013.01); *C11D 3/50* (2013.01); *C11D 17/0013* (2013.01); *C11D 1/72* (2013.01)

(58) Field of Classification Search

CPC ..... C11D 1/22; C11D 1/662; C11D 3/2003; C11D 3/22; C11D 3/227

See application file for complete search history.

(56) References Cited

U.S. PATENT DOCUMENTS

| | | | |
|---|---|---|---|
| 4,929,380 | A | 5/1990 | Schulz et al. |
| 5,340,390 | A | 8/1994 | Magauran et al. |
| 5,531,918 | A | 7/1996 | Outtrup et al. |
| 5,693,520 | A | 12/1997 | Branner et al. |
| 5,763,385 | A | 6/1998 | Bott et al. |
| 5,856,164 | A | 1/1999 | Outtrup et al. |
| 5,858,757 | A | 1/1999 | Von Der Osten et al. |
| 5,989,169 | A | 11/1999 | Svendsen et al. |
| 6,093,562 | A | 7/2000 | Bisgard-Frantzen et al. |
| 6,124,127 | A | 9/2000 | Andersen et al. |
| 6,136,769 | A | 10/2000 | Asano et al. |
| 6,159,925 | A | 12/2000 | Blandiaux |
| 6,242,406 | B1 | 6/2001 | Katsuda et al. |
| 6,281,187 | B1 | 8/2001 | Smerznak |
| 6,297,037 | B1 | 10/2001 | Barnett et al. |
| 6,297,038 | B1 | 10/2001 | Bisgård-Frantzen et al. |
| 6,300,116 | B1 | 10/2001 | von der Osten et al. |
| 6,403,331 | B1 | 6/2002 | Christianson et al. |
| 6,429,000 | B1 | 8/2002 | Andersen et al. |
| 6,576,602 | B1 | 6/2003 | Smerznak et al. |
| 6,673,589 | B2 | 1/2004 | Borchert et al. |
| 6,740,630 | B2 | 5/2004 | Aouad et al. |
| 7,109,016 | B2 | 9/2006 | Outtrup et al. |
| 7,169,741 | B2 | 1/2007 | Barry et al. |
| 7,183,093 | B2 | 2/2007 | Kauppinen et al. |
| 7,262,042 | B2 | 8/2007 | Weber et al. |
| 7,288,401 | B2 | 10/2007 | Hansen et al. |
| 7,611,882 | B2 | 11/2009 | Bjornvad et al. |
| 7,723,282 | B2 | 5/2010 | Fleckenstein et al. |
| 8,535,927 | B1 | 9/2013 | Jones et al. |
| 8,546,121 | B2 | 10/2013 | Aehle et al. |
| 8,852,912 | B2 | 10/2014 | Estell et al. |
| 8,883,970 | B2 | 11/2014 | Andersen et al. |
| 9,005,950 | B2 | 4/2015 | Glad et al. |
| 9,150,821 | B2 | 10/2015 | Meier et al. |
| 9,334,467 | B2 | 5/2016 | Shaw et al. |

(Continued)

FOREIGN PATENT DOCUMENTS

| | | |
|---|---|---|
| EP | 1 059 351 A1 | 12/2000 |
| WO | WO 89/06270 | 7/1989 |

(Continued)

OTHER PUBLICATIONS

U.S. Appl. No. 15/170,961, filed Jun. 2, 2016, Alan Thomas Brooker.
U.S. Appl. No. 15/170,964, filed Jun. 2, 2016, Philip Frank Souter.
U.S. Appl. No. 15/170,966, filed Jun. 2, 2016, Alan Thomas Brooker.
U.S. Appl. No. 15/170,971, filed Jun. 2, 2016, Nigel Patrick Somerville-Roberts.
U.S. Appl. No. 15/170,972, filed Jun. 2, 2016, Alan Thomas Brooker.
U.S. Appl. No. 15/170,977, filed Jun. 2, 2016, Philip Frank Souter.

(Continued)

*Primary Examiner* — Brian P Mruk
(74) *Attorney, Agent, or Firm* — Andres E. Velarde; Melissa G. Krasovic

(57) ABSTRACT

A liquid laundry detergent composition that includes: a liquid phase; and a solid cellulosic polymer, where the solid is dispersed within the liquid phase.

17 Claims, No Drawings

(56) References Cited

U.S. PATENT DOCUMENTS

| | | | | |
|---|---|---|---|---|
| 9,360,659 | B2 | 6/2016 | Stauffer | |
| 2006/0003913 | A1 | 1/2006 | Boutique et al. | |
| 2006/0035323 | A2 | 2/2006 | Frantzen et al. | |
| 2006/0065053 | A1 | 3/2006 | Goto | |
| 2007/0010416 | A1 | 1/2007 | Wu et al. | |
| 2007/0161531 | A1 | 7/2007 | Draborg et al. | |
| 2008/0167213 | A1 | 7/2008 | Fano et al. | |
| 2008/0193999 | A1 | 8/2008 | Andersen et al. | |
| 2009/0275078 | A1 | 11/2009 | Andersen et al. | |
| 2009/0312220 | A1* | 12/2009 | Boutoille | C11D 3/40 510/277 |
| 2010/0040884 | A1 | 2/2010 | Smets et al. | |
| 2010/0279383 | A1 | 11/2010 | Roggen et al. | |
| 2011/0212876 | A1 | 9/2011 | Meek et al. | |
| 2012/0156733 | A1 | 6/2012 | Cuevas et al. | |
| 2012/0172275 | A1 | 7/2012 | Jones et al. | |
| 2012/0172280 | A1 | 7/2012 | Knotzel et al. | |
| 2013/0011882 | A1 | 1/2013 | Cascao-Pereira et al. | |
| 2014/0094397 | A1 | 4/2014 | Guida et al. | |
| 2014/0201927 | A1 | 6/2014 | Bianchetti et al. | |
| 2014/0185916 | A1 | 7/2014 | Fabre et al. | |
| 2014/0338134 | A1 | 11/2014 | Fernandez-Prieto et al. | |
| 2015/0152401 | A1 | 6/2015 | Cascao-Pereira et al. | |
| 2015/0353873 | A1 | 12/2015 | Meek et al. | |
| 2016/0177238 | A1 | 6/2016 | Jackson et al. | |

FOREIGN PATENT DOCUMENTS

| | | | | |
|---|---|---|---|---|
| WO | WO 89/06279 | | 7/1989 | |
| WO | WO 94/02597 | | 2/1994 | |
| WO | WO 95/10603 | | 4/1995 | |
| WO | WO 95/23221 | | 8/1995 | |
| WO | WO 95/26392 | | 10/1995 | |
| WO | WO 96/10072 | A1 | 4/1996 | |
| WO | WO 96/034946 | | 11/1996 | |
| WO | WO 97/41204 | A1 | 11/1997 | |
| WO | WO 98/00514 | A1 | 1/1998 | |
| WO | WO 98/00518 | A1 | 1/1998 | |
| WO | WO 98/20115 | | 5/1998 | |
| WO | WO 99/00471 | | 1/1999 | |
| WO | WO 99/19445 | * | 4/1999 | C11D 3/22 |
| WO | WO 99/019467 | | 4/1999 | |
| WO | WO 99/27084 | | 6/1999 | |
| WO | WO 00/60060 | | 10/2000 | |
| WO | WO 01/44452 | | 6/2001 | |
| WO | WO 01/16285 | | 8/2001 | |
| WO | WO 02/006442 | | 1/2002 | |
| WO | WO 02/010355 | | 2/2002 | |
| WO | WO 2004/041979 | | 5/2004 | |
| WO | WO 2009/021867 | | 2/2009 | |
| WO | WO 2009/135765 | A1 | 11/2009 | |
| WO | WO 2013/160023 | A1 | 10/2013 | |

OTHER PUBLICATIONS

U.S. Appl. No. 15/170,978, filed Jun. 2, 2016, Jeremie Robert Marcel Gummel.

EP Search Report for Application No. 15170775.9-1358, dated Dec. 2, 2015, 6 pgs.

EP Search Report for Application No. 15170779.1-1358, dated Dec. 14, 2015, 6 pgs.

EP Search Report for Application No. 15170782.5-1358, dated Dec. 11, 2015, 7 pgs.

EP Search Report for Application No. 16158402.4-1358, dated Aug. 11, 2016, 8 pgs.

EP Search Report for Application No. 15170800.5-1358, dated Dec. 14, 2015, 8 pgs.

EP Search Report for Application No. 15170802.1-1358, dated Dec. 11, 2015, 5 pgs.

EP Search Report for Application No. 15170805.4-1358, dated Dec. 10, 2015, 7 pgs.

EP Search Report for Application No. 15170808.8-1358, dated Dec. 11, 2015, 7 pgs.

* cited by examiner

COMPACTED LIQUID LAUNDRY DETERGENT COMPOSITION

FIELD OF THE INVENTION

The present invention is to the field of liquid laundry detergent compositions and their methods of use.

BACKGROUND OF THE INVENTION

Liquid laundry detergent compositions with low equilibrium relative humidities have the advantage of being less susceptible to microbial contamination. There is also a trend towards so called compacted liquids that minimise the presence of unnecessary 'filler' liquids such as water. Such compositions are more environmentally friendly as less unnecessary material needs to be transported, so reducing the environmental impact of such transport operations. Therefore, there is a move in the industry to using so called compacted liquids which minimise the levels of non-active materials such as water. Such liquid laundry detergent compositions require both the presence of anionic surfactant such as linear alkylbenzene sulphonate and other non-surfactant cleaning and/or care actives.

However, such compacted composition can often have high viscosities due to the high relative concentration of the cleaning materials such as anionic surfactants. Traditionally, hydroxyl-containing amines have been used in such compositions to ensure consumer acceptable viscosity of the liquid laundry detergent composition. Also, acceptable viscosity is required to allow processability of the composition during manufacture. The hydroxyl-containing amines are often used as neutralising agents for the anionic detergent surfactants such as linear alkylbenzene sulphonate.

However, there is now a desire to reduce the overall level of such hydroxyl-containing amines.

Reduction in the level of the hydroxyl-containing amines of known low relative humidity laundry detergent compositions can result in high viscosity of the composition which negatively impacts the ability of the consumer to accurately pour and dose the composition. Also, processability of the composition is impacted as it is difficult to handle such viscous compositions during manufacture.

Thus, there is a need in the art for low relative humidity liquid laundry detergent compositions containing lower levels of hydroxyl-containing amine compounds, but which exhibit consumer acceptable and/or process acceptable viscosities.

It has been surprisingly found that the above problems are overcome by the specific formulation space of the present invention. The formulation space described below can provide a liquid composition having a low relative humidity and comprising lower levels of hydroxyl-containing amine compounds but which has acceptable viscosity.

SUMMARY OF THE INVENTION

The present invention is also to a liquid laundry detergent composition of comprising;

a. a liquid phase;

b. between 0.5% and 15% by weight of the liquid detergent composition of a solid cellulosic polymer, wherein the solid is dispersed within the liquid phase and wherein the water-soluble solid phase is defined as the solid obtained when the liquid laundry detergent composition is centrifuged at 1200 G for 10 mins; and wherein the liquid phase comprises between 5% and 40% by weight of the liquid of an alcohol selected from the group comprising ethylene glycol, 1,3 propanediol, 1,2 propanediol, tetramethylene glycol, pentamethylene glycol, hexamethylene glycol, 2,3-butane diol, 1,3 butanediol, diethylene glycol, triethylene glycol, polyethylene glycol, glycerol formal, dipropylene glycol, polypropylene glycol, dipropylene glycol n-butyl ether, and mixtures thereof, preferably the alcohol is selected from the group comprising 1,2 propanediol, dipropylene glycol, polypropylene glycol, 2,3-butane diol, dipropylene glycol n-butyl ether and mixtures thereof; and wherein the composition comprises between 0.5% and 50% by weight of the composition of water; and from 10% to 30% by weight of the composition of a non-amine neutralized linear alkylbenzene sulphonate and wherein the liquid laundry detergent composition comprises less than 10% by weight of the liquid laundry detergent composition of an amine-neutralised anionic surfactant; and from 0% to 25% by weight of the composition of a non-ionic surfactant;

wherein the composition comprises less than 5% by weight of the composition of a hydroxyl-containing amine.

DETAILED DESCRIPTION OF THE INVENTION

Laundry Detergent Composition

The liquid laundry detergent composition of the present invention comprises a liquid phase and a solid cellulosic polymer. The solid is dispersed within the liquid phase. Suitable cellulosic polymers are described in more detail below. The solid and liquid phases are described in more detail below.

Preferably, the liquid laundry detergent composition has a viscosity of between 300 mPa·s and 700 mPa·s, more preferably between 350 mPa·s and 600 mPa·s at a shear rate of 1000 $s^{-1}$. An exemplary method for measuring viscosity is to use a Rheometer DHR1 from TA instruments using a gap of 1000 μm at 20° C. as according to the manufacturer's instructions.

The liquid laundry detergent composition of the present invention is preferably opaque. Without wishing to be bound by theory, consumers prefer opaque compositions as this signals excellent cleaning. By opaque we herein mean the composition has a fresh hunter L value of greater than 70, more preferably greater than 72, more preferably greater than 75. The Hunter colour space is organized as a cube. The L axis runs from top to bottom; the maximum L being 100 which is white and the minimum value is zero, which is black. The a and b axes have no specific numerical limits, however positive a is red, negative a is green, positive b is yellow and negative b is blue (see FIG. 1). Delta values (ΔL, Δa and Δb) can be measured and are associated with a colour change. The total colour difference, ΔE, can also be calculated. The ΔE is a single value that takes into account the differences between the L, a and b of test and comparison samples. The ΔE is calculated as follows;

Using $L_1$, $a_1$, $b_1$ and $L_2$, $a_2$ and $b_2$ $$\Delta E=\sqrt{(L_2-L_1)^2+(a_2-a_1)^2+(b_2-b_1)^2}$$

A just noticeable difference (JND) is characterized as a ΔE of greater than 2.3. The JND is the smallest detectable difference possible with the human eye between a starting and secondary level of a particular sensory stimulus.

The measurements of the present invention are taken on a HunterLab colour measurement instrument (Hunter Lab Color Quest XE), set as follows;

Illuminant: D65, Angle of observer: 10°, Mode: reflection

The instrument is used as per the manufacturer's instructions. A sample of 20 mL are tested in an optically clear glass cell having a fixed path length of 10 mm and dimensions 55 mm by 57 mm. The measurement type is reflectance measurement RSIN, which measures the diffuse and specular reflectance of the sample at the port. The measurements are made with the specular exclusion port door closed.

Fresh Hunter colour value is a measure of the colour parameters of a fresh sample, immediately after preparation.

The liquid laundry detergent composition of the present invention overall is liquid in nature. That is to say, even though it comprises a solid dispersed within a liquid phase, the composition has the nature of a liquid rather than a solid or granular composition. In relation to the laundry detergent composition of the present invention, the term 'liquid' encompasses forms such as dispersions, gels, pastes and the like. The liquid composition may also include gases in suitably subdivided form. However, the liquid composition excludes forms which are non-liquid overall, such as tablets or granules.

The term 'liquid laundry detergent composition' refers to any laundry detergent composition comprising a liquid capable of wetting and treating fabric e.g., cleaning clothing in a domestic washing machine, The liquid composition may be formulated into a unit dose article. The unit dose article of the present invention comprises a water-soluble film which fully encloses the liquid composition in at least one compartment. Suitable unit dose articles are described in more detail below.

The liquid laundry detergent composition can be used as a fully formulated consumer product, or may be added to one or more further ingredient to form a fully formulated consumer product. The liquid laundry detergent composition may be a 'pre-treat' composition which is added to a fabric, preferably a fabric stain, ahead of the fabric being added to a wash liquor.

The liquid laundry detergent composition comprises from 10% to 30% by weight of the composition of linear alkylbenzene sulphonate.

The liquid laundry detergent composition comprises from 0% to 25% by weight of the composition of a non-ionic surfactant.

The liquid laundry detergent composition comprises less than 10% by weight, or even less than 5% by weight, or even less than 2% by weight of the liquid laundry detergent composition of an amine-neutralised anionic surfactant, wherein the anionic surfactant is preferably selected from the group comprising linear alkylbenzene sulphonate, alkyl sulphate and mixtures thereof.

The liquid laundry detergent composition comprises between 0.5% and 20% by weight of the composition of water and may have an equilibrium relative humidity of less than 65% at 20° C.

The composition comprises less than 5% by weight of the composition of a hydroxyl-containing amine. Suitable amines are described in more detail below.

The liquid laundry detergent composition may comprise a structurant. Suitable structurants are described in more detail below.

The liquid laundry detergent composition may comprise a perfume raw material. The perfume raw material is preferably selected from aldehydes, ketones or a mixture thereof.

The liquid laundry detergent composition of the present invention may comprise adjunct ingredients, wherein the adjunct ingredients are present in the solid phase, the liquid phase or both.

Without wishing to be bound by theory, it is believed that the removal of the hydroxyl-containing amine compounds results in a number of detergent ingredients to come out of solution. This in turn results in increase viscosity of the composition. The present invention carefully balances the form of the ingredients between liquid and solid form so resulting a composition of acceptable viscosity.

Furthermore, removal of the hydroxyl-containing amine can cause the formulation to phase split (i.e. at least two visibly distinct phases can be seen). The present invention provides the additional benefit of providing a composition having a low relative humidity and lower levels of alcohol containing amine compounds, whilst minimising phase splitting.

Solid Cellulosic Polymer

The liquid laundry detergent composition of the present invention comprises between 0.5% and 15% by weight of the liquid detergent composition of a solid cellulosic polymer, wherein the solid cellulosic polymer is dispersed in the liquid phase. Preferably the cellulosic polymer is partially or completely water-soluble.

Cellulosic polymers made provide softening, cleaning, other care benefits or mixtures thereof. Preferably the cellulosic polymer provides a softening benefit, more preferably a softening benefit whilst maintaining excellent cleaning benefit.

By 'solid' we herein mean any material that is solid, i.e. not liquid. The solid may be in particulate form. The term 'particles' is herein used in its broadest meaning. The particles may have a mean particle size distribution of between 2 μm and 50 μm.

By 'water-soluble' we herein mean at least 75%, or even at least 85% or even at least 95% of the solid dissolves in water as measured by the method set out here after using a glass-filter with a maximum pore size of 20 microns:

5 grams±0.1 gram of solid is added in a pre-weighed 3 L beaker and 2 L±5 ml of distilled water is added. This is stirred vigorously on a magnetic stirrer, Labline model No. 1250 or equivalent and 15 cm magnetic stirrer, set at 600 rpm, for 30 minutes at 35° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

The water-soluble solid can be obtained when the liquid laundry detergent composition is centrifuged at 1200 G for 10 mins. A preferred method is;

1. Before use, pre heat the centrifuge (Sigma Centrifuge 6-15H, 6-pot rotor) to the desired temperature. When loading centrifuge tubes into the rotor, they should always be placed opposite each other in diametrically opposed positions, number of samples can be tested are 2, 3, 4 and 6.
2. 85 ml polycarbonate with screw lids test tubes are used. Each tube was filled with 50 g of material and the total mass: tube+lid+testing material measured
3. Place the tubes in the centrifuge rotor so that they are evenly spaced, and fasten the rotor cover firmly. When loading centrifuge tubes into the rotor, they should always be placed opposite each other in diametrically opposed positions, number of samples can be tested are 2, 3, 4 and 6.

4. Set the centrifuge time to 90 minutes. Start the centrifuge (it will gradually increase the speed automatically until 17119 Relative Centrifugal Force (Maximum RCF for this centrifuge is used to maximise the separation rate) is achieved.
5. At the end of the 90 minutes, reweigh each tube to ensure that no material has been lost, as centrifuge tubes can crack after several uses.
6. Different fractions can result at end of the centrifugation and the number of fractions depends on the nature of the sample, solid fraction is the most dense, opaque fraction at the bottom and the relative high viscosity. The bottom fraction can then be obtained by simply removing the top phase(s) from the tube.

The liquid laundry detergent composition may comprise between 0.5% and 10%, or even between 0.5% and 7.5% or even between 0.5% and 5% by weight of the liquid laundry detergent composition of the solid cellulosic polymer.

The cellulosic polymer may be selected from alkyl cellulose, alkyl alkoxyalkyl cellulose, carboxyalkyl cellulose, alkyl carboxyalkyl, and any combination thereof. The cellulosic polymer may be selected from carboxymethyl cellulose, methyl cellulose, methyl hydroxyethyl cellulose, methyl carboxymethyl cellulose, hydrophobically modified hydroxyethyl cellulose and mixtures thereof.

The cellulosic polymer may comprise a carboxymethyl cellulose. The carboxymethyl cellulose may have a degree of carboxymethyl substitution from 0.5 to 0.9 and a molecular weight from 100,000 Da to 300,000 Da.

The carboxymethyl cellulose may have a degree of substitution (DS) of from 0.01 to 0.99 and a degree of blockiness (DB) such that either DS+DB is of at least 1.00 or $DB+2DS-DS^2$ is at least 1.20. The substituted carboxymethyl cellulose can have a degree of substitution (DS) of at least 0.55. The carboxymethyl cellulose can have a degree of blockiness (DB) of at least 0.35. The substituted cellulosic polymer can have a DS+DB, of from 1.05 to 2.00.

The cellulosic polymer may comprise a hydrophobically modified carboxyethyl cellulose. The hydrophobically modified carboxyethyl cellulose may be derivatised with trimethyl ammonium substituted epoxide. The polymer may have a molecular weight of between 100,000 and 800,000 daltons.

The hydrophobically modified carboxyethyl cellulose may have repeating substituted anhydroglucose units that correspond to the general Structural Formula I as follows:

Structural Formula I

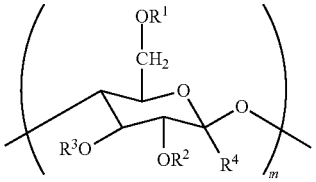

wherein:

a. m is an integer from 20 to 10,000
b. Each R4 is H, and $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

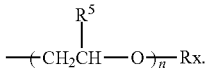

Preferably, $R^1$, $R^2$, $R^3$ are each independently selected from the group consisting of: H; $C_1$-$C_4$ alkyl;

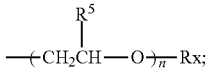

and mixtures thereof;

wherein:

n is an integer selected from 0 to 10 and

Rx is selected from the group consisting of: $R_5$;

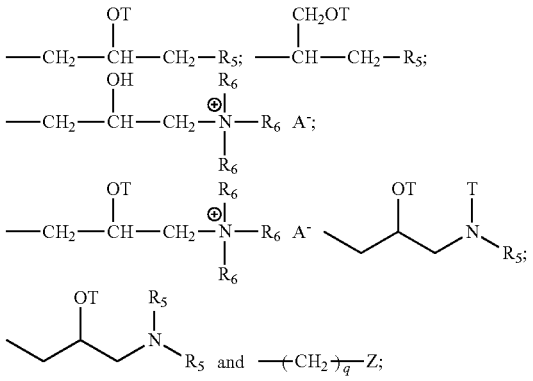

wherein said polysaccharide comprises at least one Rx, and said Rx has a structure selected from the group consisting of:

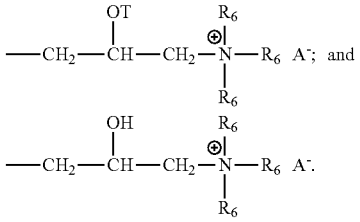

wherein $A^-$ is a suitable anion. Preferably, $A^-$ is selected from the group consisting of: $Cl^-$, $Br^-$, $I^-$, methylsulfate, ethylsulfate, toluene sulfonate, carboxylate, and phosphate;

Z is selected from the group consisting of carboxylate, phosphate, phosphonate, and sulfate.

q is an integer selected from 1 to 4;

each $R_5$ is independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, and OH. Preferably, each $R_5$ is selected from the group consisting of: H, $C_1$-$C_{32}$ alkyl, and $C_1$-$C_{32}$ substituted alkyl. More preferably, $R_5$ is selected from the group consisting of H, methyl, and ethyl.

Each $R_6$ is independently selected from the group consisting of: H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl. Preferably, each $R_6$ is selected from the group consisting of: H, $C_1$-$C_{32}$ alkyl, and $C_1$-$C_{32}$ substituted alkyl.

Each T is independently selected from the group: H,

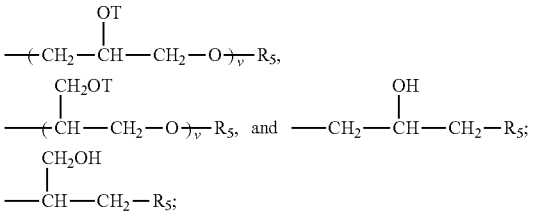

wherein each v in said polysaccharide is an integer from 1 to 10. Preferably, v is an integer from 1 to 5. The sum of all v indices in each Rx in said polysaccharide is an integer from 1 to 30, more preferably from 1 to 20, even more preferably from 1 to 10. In the last

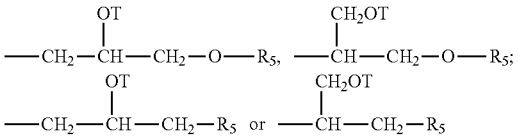

group in a chain, T is always an H.

Alkyl substitution on the anhydroglucose rings of the polymer may range from 0.01% to 5% per glucose unit, more preferably from 0.05% to 2% per glucose unit, of the polymeric material.

The cationic cellulose may be lightly cross-linked with a dialdehyde, such as glyoxal, to prevent forming lumps, nodules or other agglomerations when added to water at ambient temperatures.

The cationic cellulose polymers of Structural Formula I likewise include those which are commercially available and further include materials which can be prepared by conventional chemical modification of commercially available materials. Commercially available cellulose polymers of the Structural Formula I type include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydoxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches described by D. B. Solarek in Modified Starches, Properties and Uses published by CRC Press (1986) and in U.S. Pat. No. 7,135,451, col. 2, line 33-col. 4, line 67.

The solid phase may comprise a carboxymethyl cellulose and a hydrophobically modified hydroxyethyl cellulose. Preferably, the ratio of carboxymethyl cellulose to hydrophobically modified hydroxyethyl cellulose is between 5:1 and 1:5, preferably between 3:1 and 1:3, more preferably between 3:1 and 2.5:1. The carboxmethyl cellulose and hydrophobically modified hydroxyethyl cellulose may be present in the same particles, different particles or a combination thereof. Without wishing to be bound by theory it was surprisingly found that the combination of carboxymethyl cellulose and hydrophobically modified hydroxyethyl cellulose provided excellent softening, especially over multiple wash cycles whilst maintaining excellent cleaning to fabrics.

Without wishing to be bound by theory, a further advantage of the present invention is minimising swelling of the cellulosic polymer. There is a tendency for cellulosic polymers to swell in the presence of solvent, causing further unacceptable increases in viscosity. The present invention carefully regulates the type of solvent used in the presence of the cellulosic polymer (i.e. specific alcohol of the present invention) to minimise the swelling effect of the cellulosic polymers.

Liquid Phase

The liquid laundry detergent composition of the present invention comprises a liquid phase into which the solid active is dispersed.

The liquid phase comprises between 5% and 40% by weight of the composition of an alcohol. The alcohol is described in more detail below.

The liquid phase may comprise a natural or synthetically derived fatty alcohol ethoxylate non-ionic surfactant. Preferred synthetically derived fatty alcohol ethoxylate non-ionic surfactant or those derived from the oxo-synthesis process, or so-called oxo-synethesised non-ionic surfactants.

Non-Ionic Surfactant

The composition comprises from 0% to 25% or even from 0.1% to 25% by weight of the composition of non-ionic surfactant, preferably fatty alcohol ethoxylate non-ionic surfactant.

The fatty alcohol ethoxylate nonionic surfactant may be, e.g., primary and secondary alcohol ethoxylates, especially the $C_8$-$C_{20}$ aliphatic alcohols ethoxylated with an average of from 1 to 50 or even 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

The ethoxylated fatty alcohol non-ionic surfactant can be, for example, a condensation product of from 3 to 8 mol of ethylene oxide with 1 mol of a primary alcohol having from 9 to 15 carbon atoms.

The non-ionic surfactant may comprise a fatty alcohol ethoxylate of formula $R(EO)_n$, wherein R represents an alkyl chain between 4 and 30 carbon atoms, (EO) represents one unit of ethylene oxide monomer and n has an average value between 0.5 and 20.

The composition may comprise other non-ionic surfactants, preferably natural or synthetic non-ionic surfactants.

Preferably, the liquid phase comprises from 0% to 25% by weight of the composition of the non-ionic surfactant, more preferably the liquid phase comprises from 0% to 25% by weight of the liquid phase of a fatty alcohol ethoxylate non-ionic surfactant.

Alcohol

The liquid phase comprises between 5% and 40%, or even between 5% and 20% or even between 5% and 15% by weight of the composition of an alcohol, preferably, wherein the alcohol has a molecular weight of between 20 and 400 and an eRH of between 50% and 80%, or even between 52% and 75% at 20° C. as measured via the alcohol eRH test.

The alcohol eRH test comprises the steps of preparing a solution of 80% alcohol in deionised water, followed by adding this to a calibrated Rotronic Hygrolab meter (in a plastic sample liner of 14 mm depth) at room temperature (20° C.+/−1° C.) and allowing this to equilibrate for 25 minutes, and finally measuring the eRH recorded. The volume of sample used was sufficient to fill the plastic sample liner.

By 'alcohol' we herein mean either a single compound or a mixture of compounds that when taken together collectively each have a molecular weight of between 20 and 400 and an overall eRH of the compound or mixture of between 50% and 80% at 20° C. as measured via the alcohol eRH test. Without wishing to be bound by theory, an alcohol is any compound comprising at least one OH unit, preferably polyols and diols, more preferably diols. Preferred diols included glycols.

The alcohol may be selected from the group comprising ethylene glycol, 1,3 propanediol, 1,2 propanediol, tetramethylene glycol, pentamethylene glycol, hexamethylene glycol, 2,3-butane diol, 1,3 butanediol, diethylene glycol, triethylene glycol, polyethylene glycol, glycerol formal, dipropylene glycol, polypropylene glycol, dipropylene glycol n-butyl ether, and mixtures thereof.

The alcohol may be selected from the group comprising ethylene glycol, 1,2 propanediol, 2,3-butane diol, 1,3 butanediol, triethylene glycol, polyethylene glycol, glycerol formal, dipropylene glycol, polypropylene glycol, dipropylene glycol n-butyl ether, and mixtures thereof.

More preferably the alcohol is selected from the group comprising 1,2 propanediol, dipropylene glycol, polypropylene glycol, 2,3-butane diol, dipropylene glycol n-butyl ether and mixtures thereof.

The alcohol may be selected from the group comprising 1,2 propanediol, dipropylene glycol, polypropylene glycol, dipropylene glycol n-butyl ether and mixtures thereof.

Anionic Surfactant

The liquid laundry detergent composition comprises from 10% to 30% by weight of the composition of a non-amine neutralized linear alkylbenzene sulphonate. The linear alkylbenzene sulphonate may be present in the liquid or may be present as a solid, or a mixture thereof. If the linear alkylbenzene sulphonate is present as a solid, preferably it is in the form of a lamellar liquid crystal alkylbenzene sulphonate. By 'lamellar liquid crystal' we herein mean the system being in a state where the surfactant molecules are organised in stacks of bilayers of surfactant in the melted state separated by thin layers of solvent. This structure has both liquid properties in term of flowability as well as solid properties in term of being structured. The structure is characterised by its d-spacing, the sum of the bilayer thickness and the solvent layer between sheets. The repetition and periodicity of this structure yields to sharp x-ray diffraction peaks characteristic of crystal phases.

Non-amine neutralized linear alkylbenzene sulphonates are those in which the linear alkylbenzene sulphonic acid is neutralized to the correspond linear alkylbenzene sulphonate salt using a neutralizing material other than an amine. Non-limiting examples of such neutralizing groups include sodium, potassium, magnesium and mixtures thereof. The non-amine neutralized linear alkylbenzene sulphonate may be a sodium linear alkylbenzene sulphonate, a potassium alkylbenzene sulphonate, a magnesium alkylbenzene sulphonate or a mixture thereof.

Exemplary linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear. Alkyl benzene sulfonates are well known in the art. Especially useful are the sodium, potassium and magnesium linear straight chain alkylbenzene sulfonates in which the average number of carbon atoms in the alkyl group is from about 11 to 14.

The cleaning technology may comprise an amine neutralized anionic surfactant, preferably an amine neutralized linear alkylbenzene sulphonate, an amine neutralized alkyl sulphate or a mixture thereof. The liquid laundry detergent composition may comprise an amine neutralized anionic surfactant in the solid phase, liquid phase or both.

The liquid laundry detergent composition may comprise an alkyl sulphate anionic surfactant. The liquid laundry detergent composition may comprise from 10% to 30% or even from 15% to 25% by weight of the laundry detergent composition of alkyl sulphate anionic surfactant.

The alkyl sulphate anionic surfactant may be non-amine neutralised, amine neutralised or a mixture thereof, preferably the alkyl sulphate is non-amine neutralised. The non-amine neutralized alkyl sulphate may be a sodium alkyl sulphate, a potassium alkyl sulphate, a magnesium alkyl sulphate or a mixture thereof.

The alkyl sulphate anionic surfactant may be present in the liquid or may be present as a solid, or a mixture thereof. If the alkyl sulphate is present as a solid, preferably it is in the form of a lamellar liquid crystal alkyl sulphate. The alkyl sulphate anionic surfactant may be alkoxylated or non-alkoxylated or a mixture thereof. The alkyl sulphate anionic surfactant may be a $C_{10}$-$C_{20}$ primary, branched-chain and random alkyl sulfates (AS), including predominantly $C_{12}$ alkyl sulfates. Alternatively, the alkyl sulphate anionic surfactant may be a $C_{10}$-$C_{18}$ secondary (2,3) alkyl sulfates. Alternatively, the alkyl sulphate anionic surfactant may be a $C_{10}$-$C_{18}$ alkyl alkoxy sulfates ($AE_xS$) wherein x is from 1-30. Alternatively, the alkyl sulphate anionic surfactant may be a mixture of all the above alkyl sulphate anionic surfactants. Non-limiting examples of suitable cations for the alkyl sulphate anionic surfactant include sodium, potassium, ammonium, amine and mixtures thereof.

Amine

The composition comprises less than 5% by weight of the composition of a hydroxyl-containing amine compound, or even from 0.1% to 5%, or even from 0.1% to 4% by weight of the composition of a hydroxyl-containing amine compound. By 'hydroxyl-containing amine compound' we herein mean a compound comprising an alcohol (OH) group and an amine group. The hydroxyl-containing amine compound may be selected from monoethanolamine, triethanolamine, diisopropanolamine, triisopropanolamine, Monoamino hexanol, 2-[(2-methoxyethyl) methylamino]-ethanol, Propanolamine, N-Methylethanolamine, diethanolamine, Monobutanol amine, Isobutanolamine, Monopentanol amine, 1-Amino-3-(2-methoxyethoxy)-2-propanol, 2-Methyl-4-(methylamino)-2-butanol, 6-amino-1-hexanol, Heptaminol, Isoetarine, Norepinephrine, Sphingosine, Phenylpropanolamine and mixtures thereof.

The hydroxyl-containing amine compound may be selected from the group comprising monoethanol amine, triethanolamine and mixtures thereof.

Preferably, the hydroxyl-containing amine compound has a molecular weight of less than 500, or even less than 250.

The composition may comprise other amine containing compounds.

Structurant

The composition of the present invention may comprises less than 2% by weight of the composition of a structurant. If a structurant is present, preferably the composition comprises from 0.05% to 2%, preferably from 0.1% to 1% by weight of a structurant. The structurant may be selected from non-polymeric or polymeric structurants. The structurant may be a non-polymeric structurant, preferably a crystallisable glyceride. The structurant may be a polymeric structurant, preferably a fibre based polymeric structurant, more preferably a cellulose fibre-based structurant. The structurant may be selected from crystallisable glyceride, cellulose-fibre based structurants, $TiO_2$, silica and mixtures thereof.

Suitable structurants are preferably ingredients which impart a sufficient yield stress or low shear viscosity to stabilize the liquid laundry detergent composition independently from, or extrinsic from, any structuring effect of the detersive surfactants of the composition. Preferably, they impart to the laundry detergent composition a high shear viscosity at 20 sec-1 at 21° C. of from 1 to 1500 cps and a viscosity at low shear (0.05 sec-1 at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1−1 to 25−1 in 3 minutes time at 21° C.

The structurant may be a polymeric crystalline, hydroxy-functional structurant that comprises a crystallizable glyceride, preferably hydrogenated castor oil or "HCO". HCO as used herein most generally can be any hydrogenated castor oil or derivative thereof, provided that it is capable of crystallizing in the non-polymeric crystalline, hydroxy-functional structurant premix. Castor oils may include glycerides, especially triglycerides, comprising $C_{10}$ to $C_{22}$ alkyl or alkenyl moieties which incorporate a hydroxyl group. Hydrogenation of castor oil, to make HCO, converts the double bonds which may be present in the starting oil as ricinoleyl moieties. As such, the ricinoleyl moieties are converted into saturated hydroxyalkyl moieties, e.g., hydroxystearyl. The HCO herein may be selected from: trihydroxystearin; dihydroxystearin; and mixtures thereof. The HCO may be processed in any suitable starting form, including, but not limited to those selected from solid, molten and mixtures thereof. HCO is typically present at a level of from 2% to 10%, from 3% to 8%, or from 4% to 6% by weight in the external structuring system. The corresponding percentage of hydrogenated castor oil delivered into a finished laundry detergent product may be below 1.0%, typically from 0.1% to 0.8%. HCO may be present at a level of between 0.01% and 1%, or even between 0.05% and 0.8% by weight of the laundry detergent composition.

HCO of use in the present invention includes those that are commercially available. Non-limiting examples of commercially available HCO of use in the present invention include: THIXCIN® from Rheox, Inc.

The structurant may comprise a fibre-based structurant. The structurant may comprise a microfibrillated cellulose (MFC), which is a material composed of nanosized cellulose fibrils, typically having a high aspect ratio (ratio of length to cross dimension). Typical lateral dimensions are 1 to 100, or 5 to 20 nanometres, and longitudinal dimension is in a wide range from nanometres to several microns. For improved structuring, the microfibrillated cellulose preferably has an average aspect ratio (l/d) of from 50 to 200,000, more preferably from 100 to 10,000. Microfibrillated cellulose can be derived from any suitable source, including bacterial cellulose, citrus fibers, and vegetables such as sugar beet, chicory root, potato, carrot, and the like.

The structurant may be selected from the group consisting of titanium dioxide, tin dioxide, any forms of modified $TiO_2$, $TiO_2$ or stannic oxide, bismuth oxychloride or bismuth oxychloride coated $TiO_2$, silica coated $TiO_2$ or metal oxide coated $TiO_2$ and mixtures thereof. Modified $TiO_2$ may comprise carbon modified $TiO_2$, metallic doped $TiO_2$ or mixtures thereof. Metallic doped $TiO_2$ may be selected from platinum doped $TiO_2$, Rhodium doped $TiO_2$.

The structurant may comprise silica. Those skilled in the art will know suitable silica materials to use. The silica may comprise fumed silica.

Water and Equilibrium Relative Humidity

The liquid laundry composition comprises between 0.5% and 15% by weight of the composition of water. The liquid laundry detergent composition may comprise between 0.5% and 12%, or even between 0.5% and 10% by weight of the composition of water.

The equilibrium relative humidity of the liquid laundry composition may be less than 65% at 20° C.

A preferred method for measuring the eRH of the composition is via the composition eRH test. The composition eRH test comprises the steps of adding a sample of the composition to a calibrated Rotronic Hygrolab meter (in a plastic sample liner of 14 mm depth) at room temperature (20° C.+/−1° C.) and allowing this to equilibrate for 25 minutes, and finally measuring the eRH recorded. The volume of sample used was sufficient to fill the plastic sample liner.

Adjunct Ingredients

The liquid laundry detergent composition may comprise an adjunct ingredient. The liquid laundry detergent composition may comprise from 20% to 40% by weight of the composition of an adjunct ingredient. The adjunct ingredient may be selected from the group comprising bleach, bleach catalyst, dye, hueing dye, cleaning polymers including alkoxylated polyamines and polyethyleneimines, surfactant, solvent, dye transfer inhibitors, chelant, enzyme, perfume, encapsulated perfume, soil release polymers, polycarboxylate polymers, brighteners and mixtures thereof.

Water-Soluble Pouch

The liquid laundry detergent composition may be present in a water-soluble unit dose article wherein the composition comprises between 0.5% and 15%, preferably between 0.5% and 12%, more preferably between 0.5% and 10% by weight of the composition of water. In such an embodiment, the water-soluble unit dose article comprises at least one water-soluble film shaped such that the unit-dose article comprises at least one internal compartment surrounded by the water-soluble film. The at least one compartment comprises the liquid laundry detergent composition. The water-soluble film is sealed such that the liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film may be shaped to comprise an open compartment into which the composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Method of Making

The liquid laundry detergent composition of the present invention may be made using any suitable manufacturing techniques known in the art. Those skilled in the art would know appropriate methods and equipment to make the composition according to the present invention.

A preferred process comprises the step of adding the solid phase wherein the solid phase comprises particles wherein the particles have a mean particle size distribution of less than 500 μm.

HCO premix may be formed by melting HCO and adding into a small volume of a hot liquid laundry detergent composition wherein the composition does not comprise enzymes or perfume materials. The HCO premix is then added to other ingredients to form the liquid laundry detergent composition.

Method of Use

The composition or unit dose article of the present invention can be added to a wash liquor to which laundry is already present, or to which laundry is added. It may be used in an washing machine operation and added directly to the drum or to the dispenser drawer. The washing machine may be an automatic or semi-automatic washing machine. It may be used in combination with other laundry detergent compositions such as fabric softeners or stain removers. It may be used as pre-treat composition on a stain prior to being added to a wash liquor.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

The viscosity of various compositions were compared. The following compositions were prepared;

TABLE 1

| | Compositions (wt %) | | |
|---|---|---|---|
| | A | B | C |
| water | 7.16 | 7.16 | 7.44 |
| Dipropylene glycol | 14.66 | 14.66 | 31.19 |
| 1,2-propanediol | | 10.00 | |
| Dipropylene glycol n-butyl ether | 9.80 | 9.80 | |
| Glycerol | 15.00 | 5.00 | 5.00 |
| Linear alkylbenzene sulphonate neutralized with monoethanolamine | | | 23.59 |
| Linear alkylbenzene sulphonate neutralized with sodium carbonate | 23.59 | 23.59 | |
| Ethoxylated polyethyleneimine | 2.16 | 2.16 | 2.16 |
| Alkyl sulphate with an average degree of ethoxylation of 3, neutralized with monoethanolamine | | | 11.00 |
| Alkyl sulphate with an average degree of ethoxylation of 3, neutralized with sodium carbonate | 11.00 | 11.00 | |
| HEDP | 1.81 | 1.81 | 1.81 |
| Amphiphilic graft copolymer | 2.72 | 2.72 | 2.72 |
| Brightener 49 | 0.24 | 0.24 | 0.24 |
| Soil release polymer commercially available from Clariant as SRA-300 | 0.32 | 0.32 | 0.32 |
| Carboxymethyl cellulose | 1.07 | 1.07 | 1.07 |
| Siloxane polymeric suds suppressor | 0.13 | 0.13 | 0.13 |
| Perfume | 2.68 | 2.68 | 2.68 |
| protease | 0.10 | 0.10 | 0.10 |
| TiO2 | 0.50 | 0.50 | 0.50 |
| palm kernel fatty acid | 3.26 | 3.26 | 3.26 |
| Guerbet alcohol non-ionic surfactant commercially available from BASF as Lutensol XL100 | 0.56 | 0.56 | 0.56 |
| minors | 2.36 | 2.36 | 2.77 |

The compositions were made by preparing a 1 L beaker having an IKA Eurostar 200 mixer with 10 cm impeller. This was operated at 250 rpm. To the beaker with the rotating impellar, the solvent materials were added, followed by the surfactant materials. Once these had dispersed, the polymers and salts were added. The pH of the composition was adjusted using NaOH to approximately & (measured using a Sartorius PT-10 pH meter). Remaining ingredients were then added and mixed. All materials were weighed out using a Mettler Toledo PB3002-S balance.

Composition C comprised 6.25% by weight of composition C of monoethanolamine. Compositions A and B comprised no monoethanolamine.

The viscosity of the compositions were then measured using a Rheometer DHR1 from TA instruments using a gap of 1000 μm at 20° C. Samples were equilibrated for 1 min at 0.05 $s^{-1}$ followed by a measured flow curve from 0.05 $s^{-1}$ to 1200 $s^{-1}$ over 10 mins. Results for 0.05 $s^{-1}$ and 1000 $s^{-1}$ are shown in Table 2.

TABLE 2

| | 0.05 s−1 mPa · s | 1000 s−1 mPa · s |
|---|---|---|
| A | 1560 | 870 |
| B | 1112 | 413 |
| C | 1310 | 315 |

Shear at 0.05 $s^{-1}$ corresponds to that experienced by the composition during pouring of the composition by the consumer. Shear at 1000 $s^{-1}$ corresponds to that experienced by the composition during manufacture.

Composition C which comprises 6.25% monoethanolamine shows an acceptable viscosity profile at low and high shear corresponding to consumer pouring shear and process dosing shear. However, when the monoethanolamine is removed in composition A (and correspondingly the surfactants are neutralized with sodium carbonate), there is an increase in viscosity to unacceptable levels.

Composition B corresponds to the present invention in which the monoethanolamine has been removed and the surfactants neutralized with sodium carbonate, but also 1,2-propandiol has been added. The viscosity returns to acceptable levels.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water-soluble unit dose article comprising a water-soluble film and a liquid laundry detergent composition comprising;

a. a liquid phase;

b. between about 0.5% and about 15% by weight of the liquid detergent composition of a solid cellulosic polymer, wherein the solid is dispersed within the liquid phase and wherein the water-soluble solid phase is defined as the solid obtained when the liquid laundry detergent composition is centrifuged at about 1200 G for about 10 mins; and wherein the liquid phase comprises between about 5% and about 40% by weight of the liquid of an alcohol selected from the group consisting of ethylene glycol, 1,3 propanediol, 1,2 propanediol, tetramethylene glycol, pentamethylene glycol, hexamethylene glycol, 2,3-butane diol, 1,3 butanediol, diethylene glycol, triethylene glycol, polyethylene glycol, glycerol formal, dipropylene glycol, polypropylene glycol, dipropylene glycol n-butyl ether, and mixtures thereof; and wherein the composition comprises between about 0.5% and about 50% by weight of the composition of water; and from about 10% to about 30% by weight of the composition of a non-amine neutralized linear alkylbenzene sulphonate and wherein the liquid laundry detergent composition comprises less than 10% by weight of the liquid laundry detergent composition of an amine-neutralised anionic surfactant; and from 0% to about 25% by weight of the composition of a non-ionic surfactant;

wherein the composition comprises between 0 and 0.1% by weight of the composition of a hydroxyl-containing amine; and wherein the liquid laundry detergent composition exhibits a viscosity of less than 1560 mPa·s at 0.05 s-1 and less than 870 mPa·s at 1000 s-1, wherein the water-soluble film comprises an aversive agent, wherein the aversive agent is a bittering agent selected from naringin, sucrose octaacetate, quinine hydrochloride, denatonium benzoate, or mixtures thereof.

2. The detergent composition according to claim 1, wherein the liquid laundry detergent composition comprises between about 0.5% and about 10% by weight of the liquid laundry detergent composition of the solid cellulosic polymer.

3. The detergent composition according to claim 2, wherein the liquid laundry detergent composition comprises between about 0.5% and about 7.5% by weight of the liquid laundry detergent composition of the solid cellulosic polymer.

4. The detergent composition according to claim 1, wherein the cellulosic polymer is selected from the group consisting of alkyl cellulose, alkyl alkoxyalkyl cellulose, carboxyalkyl cellulose, and any combination thereof.

5. The detergent composition according to claim 4, wherein the cellulosic polymer comprises a carboxymethyl cellulose and a hydrophobically modified hydroxyethyl cellulose.

6. The detergent composition according to claim 5, wherein the ratio of carboxymethyl cellulose to hydrophobically modified hydroxyethyl cellulose is between about 5:1 and about 1:5.

7. The detergent composition according to claim 6, wherein the ratio of carboxymethyl cellulose to hydrophobically modified hydroxyethyl cellulose is between about 3:1 and about 2.5:1.

8. The detergent composition according to claim 5, wherein the hydrophobically modified hydroxethyl cellulose is derivatised with trimethyl ammonium substituted epoxide.

9. The detergent composition according to claim 1, wherein the liquid phase comprises between about 5% and about 20% by weight of the composition of the alcohol.

10. The detergent composition according to claim 1, wherein the non-ionic surfactant comprises a natural or synthetically derived fatty alcohol ethoxylate non-ionic surfactant.

11. The detergent composition according to claim 1 comprising a structurant.

12. The detergent composition according to claim 1, wherein the solid is in particulate form and wherein the particles have a mean particle size distribution of between about 2 μm and about 50 μm.

13. The detergent composition according to claim 1 comprising a perfume raw material, wherein the perfume raw material is selected from aldehydes, ketones or a mixture thereof.

14. The detergent composition according to claim 1 comprising an adjunct ingredient, wherein the adjunct ingredient is selected from the group consisting of bleach, bleach catalyst, dye, hueing dye, cleaning polymers, surfactant, solvent, dye transfer inhibitors, chelant, enzyme, perfume, encapsulated perfume, soil release polymers, polycarboxylate polymers, brighteners, and mixtures thereof.

15. The unit dose article according to claim 1, wherein the unit dose article comprises at least two compartments.

16. The unit dose article according to claim 1, wherein the unit dose article comprises at least three compartments.

17. A process of making a composition according to claim 1, comprising the step of adding the solid phase wherein the solid phase comprises particles wherein the particles have a mean particle size distribution of less than about 500 μm.

* * * * *